United States Patent [19]

Bettger

[11] Patent Number: 4,648,643

[45] Date of Patent: Mar. 10, 1987

[54] RETROFIT LEVER ASSEMBLY FOR A DOOR KNOB

[75] Inventor: Richard R. Bettger, San Francisco, Calif.

[73] Assignee: Schlage Lock Company, San Francisco, Calif.

[21] Appl. No.: 857,509

[22] Filed: Apr. 21, 1986

Related U.S. Application Data

[63] Continuation of Ser. No. 593,380, Mar. 26, 1984, abandoned.

[51] Int. Cl.[4] ..... E05B 1/00

[52] U.S. Cl. ..... 292/347; 292/355; 292/DIG. 2

[58] Field of Search ..... 292/347-352, 292/355, DIG. 2; 74/548, 557; 403/319, 355

[56] References Cited

U.S. PATENT DOCUMENTS

| | | | |
|---|---|---|---|
| 339,440 | 4/1886 | Libby | 292/352 |
| T411,076 | 5/1943 | Jacob | 403/355 |
| 1,840,204 | 1/1932 | Kimball | 292/348 |
| 2,454,754 | 11/1948 | Netschert | 292/350 X |
| 2,756,088 | 7/1956 | Sutter | 292/DIG. 2 X |
| 2,942,909 | 6/1960 | Chase | 292/347 |
| 4,082,351 | 4/1978 | Chrones | 292/347 |
| 4,223,931 | 9/1980 | Neary | 292/347 |
| 4,319,470 | 3/1982 | White | 292/350 X |
| 4,397,489 | 8/1983 | Lind | 292/DIG. 2 X |
| 4,502,719 | 3/1985 | Perry | 292/347 |

FOREIGN PATENT DOCUMENTS

| | | | |
|---|---|---|---|
| 27953 | 3/1977 | Japan | 403/319 |
| 2471 | of 1877 | United Kingdom | 292/350 |
| 296620 | 9/1928 | United Kingdom | 292/348 |

*Primary Examiner*—Robert L. Wolfe
*Assistant Examiner*—Russell W. Illich
*Attorney, Agent, or Firm*—Walter C. Vliet

[57] ABSTRACT

The lever assembly is of two principal parts: a lever with a circular aperture to engage the shank of a door knob, and a retaining plate, for fastening thereof to the lever, having a projecting cog. The cog engages a knob catch slot in the door knob shank. Accordingly, as the lever is rotated/manipulated, it turns the door knob through the engagement of the cog with the slot, and the fastening of the plate to the lever. The assembly accommodates retrofitting thereof to doors having round door knobs.

5 Claims, 6 Drawing Figures

RETROFIT LEVER ASSEMBLY FOR A DOOR KNOB

This application is a continuation, of co-pending application Ser. No. 593,380, filed Mar. 26, 1984 now abandoned.

BACKGROUND OF THE INVENTION

The conventional cylinder or round shaped door knob can be extremely difficult to operate when a good grip of the knob is interfered with for any reason. For example, a wet or oily door knob may be quite difficult to turn. In addition, when a person does not have a free hand as in the case of carrying packages or the like, it is sometimes difficult to open a door.

Further, in the case of handicapped persons, the person may lack the gripping power required to operate the door knob or lack the wrist mobility necessary to turn the knob. Further, in the case of a handicapped person, particularly amputees, the artificial limb fitted to the handicapped may not be compatible with turning of door knobs.

For these and other reasons, lever operated door knobs are finding increased popularity and are specified in many cases for use by handicapped persons in places where handicapped persons are employed or are present.

SUMMARY OF THE INVENTION

The object of the present invention is to provide a simple, more reliable, economical, decorative and easy to use and install means for operating the conventional door knob. The object of the invention is to provide a retrofit lever assembly for use with a conventional door knob that is easy to install and does not require special tools for installation.

A further object of the invention is to provide a retrofit lever assembly which will not detract from the decorative appearance of the door knob and will allow the use of existing hardware trim.

A further object of the invention is to provide a retrofit lever assembly which has no sharp ends and which does not protrude so as to create a hazard on the door.

A further object of the invention is to provide a retrofit lever assembly which does not appreciably interfere with the normal mode of operation, that is, by hand wrapped around the door knob. The retrofit lever assembly of this invention is easily operated by the handicapped or under other adverse conditions such as emergency exits.

Further, an object of the invention is to provide a means for installing the lever without need for hardware. Thus, the invention is particularly adapted for its retrofit to existing door knobs.

It is especially an object of this invention to set forth a retrofit lever assembly comprising a lever; said lever having (a) a body portion with a substantially planar surface, and (b) an arm portion extending outwardly, from said body portion, generally parallel with said surface; said body portion having (a) an aperture formed substantially centrally therethrough, in which to accommodate a door knob shank, and (b) a relief formed therein, opening onto, and at one side of, said aperture; and retaining means for removable fastening thereof to said body portion at a side of said aperture which is opposite said one side.

Further objects of this invention, as well as the novel features thereof, will become more apparent by reference to the following description taken in conjunction with the accompanying figures which are described herebelow.

DESCRIPTION OF THE PREFERRED EMBODIMENT

Figure 1:
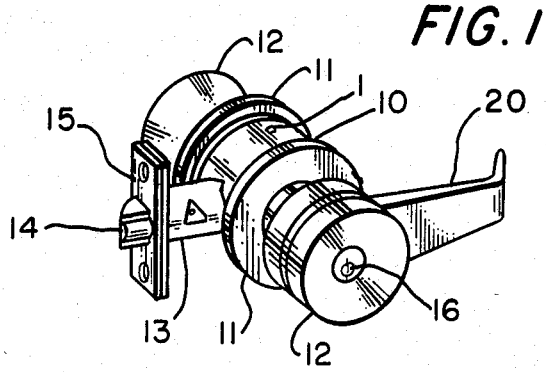
FIG. 1 shows a front side isometric view of an assembled door lock having a a retrofit lever assembly according to present invention installed thereon.

Referring to FIG. 1, a conventional lock assembly is generally shown by reference numeral 1. The lock assembly includes a body 10 having trim plates 11, door knobs 12, a latch bolt housing 13, latch 14, face plate 15, key cylinder 16 and a retrofit lever 20 assembly according to the present invention.

The lock as shown is normally installed on a door and provides a means for securing the door in its closed position. The construction of the lock is conventional.

Figure 2:
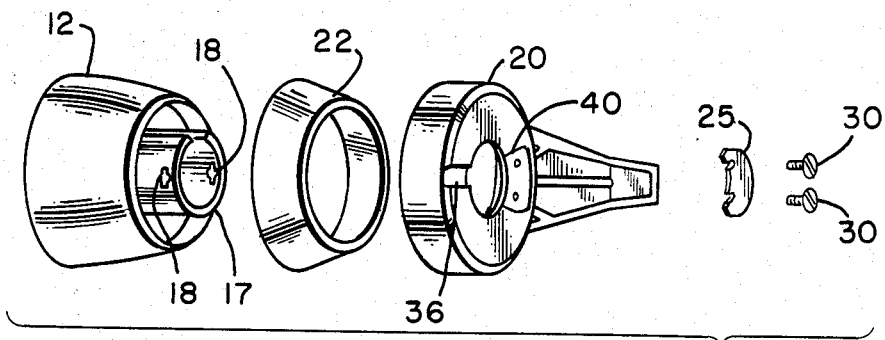
FIG. 2 shows an exploded assembly view of the back side of a door knob, having the lever assembly according to the present invention.

FIG. 2 shows an exploded assembly view of the retrofit lever assembly 20 having a spacer 22 for use with a tulip or truncated cone design door knob 12. The spacer is unnecessary for round door knobs and merely fills the void to securely seat the lever assembly against the door knob 12 in the case of the tulip design. The door knob 12 is shown having a shank 17 which connects through a spindle (not shown) to the lock body and provides the means for retracting the latch bolt upon rotation of the door knob. A knob catch slot 18 is shown on both sides of the knob shank 17 and permits reversal for different hands of rotation. A projection (not shown) on the door lock spindle coacts with the door knob catch slot to retain the knob in its position relative to the lock body and trim plates.

As can be seen in FIG. 2 the retrofit lever assembly 20 is mounted to the underside of the. The lever assembly 20 comprises a lever 20*a* which is attached to the door knob at its shank 17 by means of a retaining plate 25 which is secured to the lever 20*a* by means of screws 30. An alignment slot 36 provides access to the door knob catch slot and further provides a means for alignment relative to the slots 18 so that the retaining plate may be properly aligned and coact with its knob catch slot 18.

Figure 3:
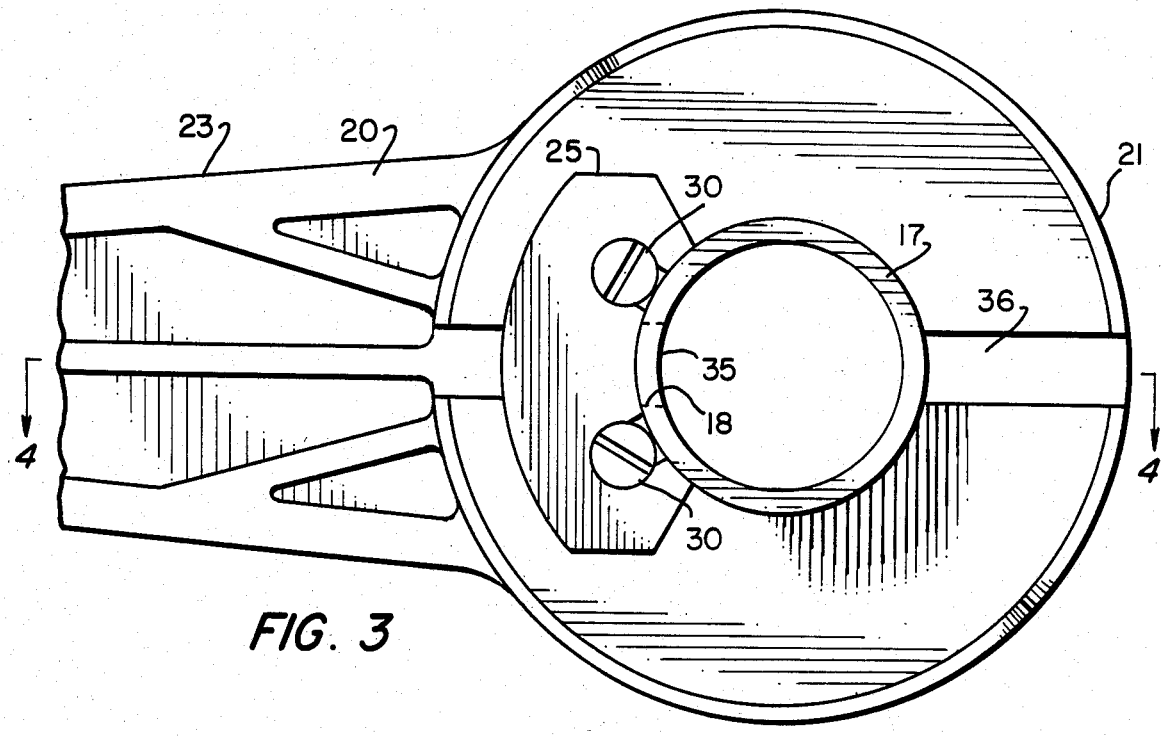
FIG. 3 is a detail view of the underside of a door knob lever assembly according to the present invention showing the retaining plate.

FIG. 3 shows the detail of the underside of the lever assembly 20. The lever 20*a* comprises two portions, a generally cylindrical body 21 which mounts the lever to the door knob and surrounds the shank 17, and an arm 23. The lever arm 23 extends from the body portion 21 for a sufficient length to provide adequate hand grip. As can be seen in FIGS. 1 and 2, the tip of the lever arm is bent back (i.e., towards where the face of an associated door would be) to minimize the possibility of a pinch point or of the lever accidentally tangling a piece of clothing or the like and thereby accidentally opening the door or tearing the clothing.

In general, the lever 20*a* may be manufactured from a plastic material such as acetal copolymer, nylon or reinforced fiberglass although any similar material which may be readily formed to the shape of the lever may be utilized effectively.

As can be seen in FIG. 3, the retaining plate 25 is provided with a cog 35 which coacts with the knob catch slot to retain the lever 20*a* in position relative to the knob. This novel attachment means provides several benefits.

First, the plastic material of the lever 20*a* is securely attached to the knob shank 17 by means of the metal cog thus providing greater strength in the localized small area of the knob catch slot. The forces generated in turning the door knob are transmitted through the cog 35 to the retaining plate 25 where the load is substantially spread through the plastic material. The mounting screws 30 merely retain the plate in a depressed slot in the lever 20*a*. The depressed slot 40 is best seen in FIG. 2.

Figure 4:
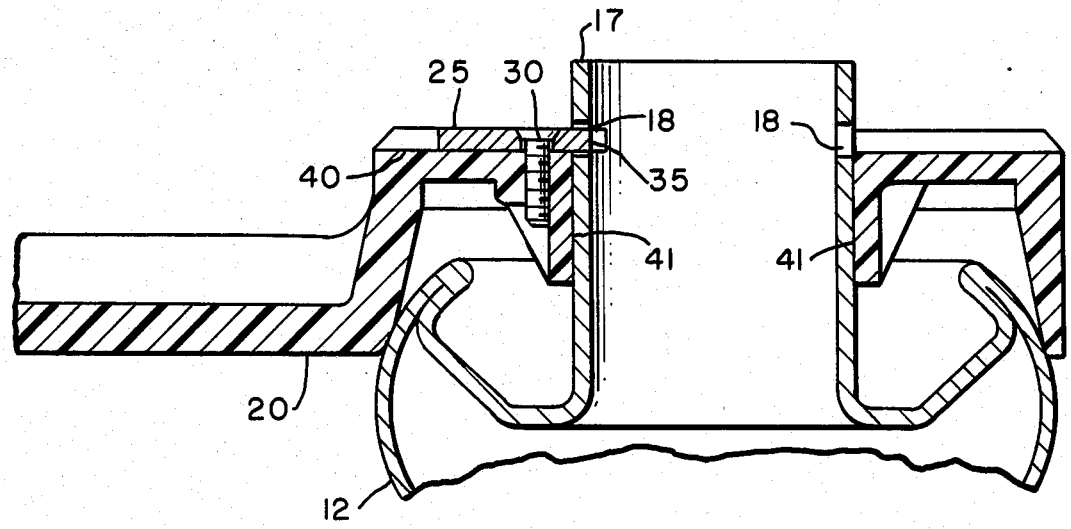
FIG. 4 is a sectional elevation view of taken about section line 4—4 of FIG. 3.

FIG. 4 shows the retrofit lever 20*a* of the present invention installed on a round type door knob. Again, the retaining plate 25 is shown mounted to the body 21 by means of the retaining screws 30. Cog 35 is shown actively engaged in the door knob catch slot 18. Bearing surfaces 41 are provided in the lever 20*a* to align the latter with the shank of the door knob. In this manner, the retrofit lever assembly 20 is retained in a secure and stable manner on the door knob.

Figure 5:
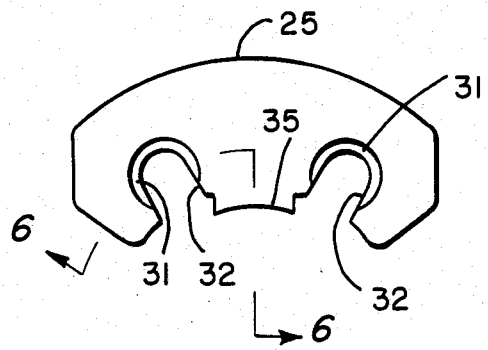
FIG. 5 is a plan view of the retaining plate according to the present invention.

FIG. 5 shows the detail of the unique retaining plate of the present invention. The plate is made of a metallic material for greater structural strength. The plate is counter sunk in the depressed slot 40 in the lever 20*a* and is retained there by screws 30 which pass through the retaining plate in slots 32. The slots 32 are provided with a screw seat 31 which securely holds the screws and plate in position.

Figure 6:
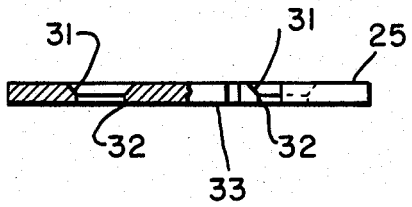
FIG. 6 is an end elevation of the retaining plate which is partially sectioned along section line 6—6 of FIG. 5.

FIG. 6 shows an elevation view of the retaining plate and further details of the screw retaining slot 32 and screw seat 31.

As can be appreciated by one skilled in the art, the present invention provides a means for securely fastening the retrofit lever assembly 20 to the door knob without the need for perforating the door knob and placing screws therein.

In addition, the unique design permits the torque applied to the door knob through the assembly 20 to be applied through metallic interface by means of the cog interacting with the door knob retaining slot 18. The forces transmitted from the lever 20*a* are transmitted to the retaining plate by means of its depressed position in the slot depression 40. The means of construction prevents the need for the torque to be transmitted through the relatively fragile screws which are holding the plate in the plastic material. The unique retaining plate design therefore permits easy installation without the need of special tools other than a screwdriver. The resulting connection is secure and durable and provides a distinct improvement over previous connecting means for such levers.

The embodiment of the retrofit lever assembly 20 depicted and described represents the best mode contemplated by the inventor for carrying out his invention. As can be seen, the body portion 21 of the lever 20*a* has a central aperture 42 formed therein. The bearing surface 41 is defined by a tubular wall 44, within which the shank 17 of the door knob 12 is received, and which bounds the aperture 42. Body portion 21 also has a circumferential wall 46 which extends substantially normal to a planar surface 48 of portion 21. Wall 46 has a terminal, annular edge 50, and arm 23 is integral with, and extends from, a sector of edge 50. It should be appreciated by one skilled in the art that the intimate contact provided by annular edge 50 with the door knob will stabilize and provide rigidity to the retrofit lever structure. To assure this contact, spacer 22 is provided in application to other door knob configurations. The added stability is an important aspect of the present invention for use with plastic material. Aperture 42 has a given radius "r", and the retaining plate 25 has an arcuate edge 52 defined of the same, given radius "r". The cog 35 projects from the edge 52.

Having described my invention in terms of a preferred embodiment, I do not wish to be limited in the scope of my invention except as claimed.

I claim:

1. A retrofit lever assembly for a door knob, having an integral door knob shank, comprising:

a lever;

said lever having (a) a body portion with a substantially planar surface, and (b) an arm portion extending outwardly, from said body portion, generally parallel with said surface;

said body portion having (a) a circular aperture formed substantially centrally therethrough, in which to accommodate a door knob shank, and (b) a relief formed therein, opening onto, and at one side of, said aperture;

retaining means disposed in said relief for removable fastening thereof to said body portion and for coacting with said door knob shank to effect retention of said lever assembly on said door knob shank;

said body portion having an outermost, circumferential wall which extends substantially normal to said surface;

said wall having an annular edge coacting with said door knob to form a stabilizing means; and said arm portion is integral with, and extends from, a sector of said edge.

2. A retrofit lever assembly, according to claim 1, wherein:

said stabilizing means further includes a spacer.

3. A retrofit lever assembly, according to claim 1, wherein:

said aperture has a given radius; and said retaining means comprises a retainer having an arcuate edge defined by said, same, given radius.

4. A retrofit lever assembly, according to claim 3, wherein:

said retainer has a cog extending from said arcuate edge.

5. A retrofit lever assembly according to claim 3, wherein:

said retainer has openings formed therein in which to receive fasteners.

* * * * *